US005884616A

United States Patent [19]

Skaleski

[11] Patent Number: 5,884,616

[45] Date of Patent: Mar. 23, 1999

[54] OVERDRAW SAFETY GUARD FOR BOWS

[76] Inventor: Chris R. Skaleski, 433 Bellevue St., Green Bay, Wis. 54302

[21] Appl. No.: 871,257

[22] Filed: Jun. 9, 1997

[51] Int. Cl.[6] ..... F41B 5/14

[52] U.S. Cl. ..... 124/88; 124/23.1; 124/86

[58] Field of Search ..... 124/23.1, 24.1, 124/25.6, 86, 88

[56] References Cited

U.S. PATENT DOCUMENTS

| | | | |
|---|---|---|---|
| 3,167,062 | 1/1965 | Zwickey | 124/23.1 |
| 3,176,674 | 4/1965 | Smith | 124/23.1 |
| 4,257,385 | 3/1981 | Stewart | 124/24.1 |
| 4,457,287 | 7/1984 | Babington | 124/23.1 |
| 5,119,796 | 6/1992 | Dehlbom | 124/23.1 |
| 5,464,002 | 11/1995 | Lavoie et al. | 124/86 |
| 5,617,838 | 4/1997 | Peruski | 124/88 |

*Primary Examiner*—John A. Ricci

[57] ABSTRACT

A safety guard for bows including a tab positionable on a bow handle having an overdraw. The tab extends forwardly from the bow handle to prevent a user's finger from sliding up from the handle into the line of fire of an arrow.

6 Claims, 3 Drawing Sheets

OVERDRAW SAFETY GUARD FOR BOWS

BACKGROUND OF THE INVENTION

1. Field of the Invention

The present invention relates to a safety guard for bows and more particularly pertains to securing around a bow handle of a bow equipped with overdraws to prevent contact with an arrowhead with a safety guard for bows.

2. Description of the Prior Art

The use of overdraw extensions is known in the prior art. More specifically, overdraw extensions heretofore devised and utilized for the purpose of allowing extended movement of an arrow are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,140,972 to Fisk discloses an overdraw extension for compound bows. U.S. Pat. No. 5,331,941 to Schaffer discloses an adjustable overdraw for compound bow. U.S. Pat. No. 4,787,361 to Vyprachticky discloses an archery bow with self-aligning combination handgrip and forearm protector. U.S. Pat. No. 4,027,645 to Damron discloses an archery bow with arrow guiding device. U.S. Pat. No. 4,620,524 to Saunders discloses an adjustable anchor tab. U.S. Pat. No. 4,949,699 to Gerber discloses an arrow guide.

While these devices fulfill their respective, particular objective and requirements, the aforementioned patents do not describe a safety guard for bows for securing around a bow handle of a bow equipped with overdraws to prevent contact with an arrowhead.

In this respect, the safety guard for bows according to the present invention substantially departs from the conventional concepts and designs of the prior art, and in doing so provides an apparatus primarily developed for the purpose of securing around a bow handle of a bow equipped with overdraws to prevent contact with an arrowhead.

Therefore, it can be appreciated that there exists a continuing need for new and improved safety guard for bows which can be used for securing around a bow handle of a bow equipped with overdraws to prevent contact with an arrowhead. In this regard, the present invention substantially fulfills this need.

SUMMARY OF THE INVENTION

In the view of the foregoing disadvantages inherent in the known types of overdraw extensions now present in the prior art, the present invention provides an improved safety guard for bows. As such, the general purpose of the present invention, which will be described subsequently in greater detail, is to provide a new and improved safety guard for bows and method which has all the advantages of the prior art and none of the disadvantages.

To attain this, the present invention essentially comprises a tab positionable on a bow handle having an overdraw. The tab extends forwardly from the bow handle. The tab has a length of about two inches. The tab has planar upper and lower surfaces, opposed linear side edges and a rounded outer edge. A circular band fabricated of a pliable material is securable around a bow handle having an overdraw. The circular band is integrally formed with the tab. The tab extends radially outwardly from an upper peripheral edge of the circular band. The circular band has a gap therein diametrically opposed from the tab. An inner surface of the circular band has adhesive disposed thereon. A peel away strip is disposed over the adhesive.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved safety guard for bows which has all the advantages of the prior art overdraw extensions and none of the disadvantages.

It is another object of the present invention to provide a new and improved safety guard for bows which may be easily and efficiently manufactured and marketed.

It is a further object of the present invention to provide a new and improved safety guard for bows which is of durable and reliable construction.

An even further object of the present invention is to provide a new and improved safety guard for bows which is susceptible of a low cost of manufacture with regard to both materials and labor, and which accordingly is then susceptible of low prices of sale to the consuming public, thereby making such a safety guard for bows economically available to the buying public.

Even still another object of the present invention is to provide a new and improved safety guard for bows for securing around a bow handle of a bow equipped with overdraws to prevent contact with an arrowhead.

Lastly, it is an object of the present invention to provide a new and improved safety guard for bows including a tab positionable on a bow handle having an overdraw. The tab extends forwardly from the bow handle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
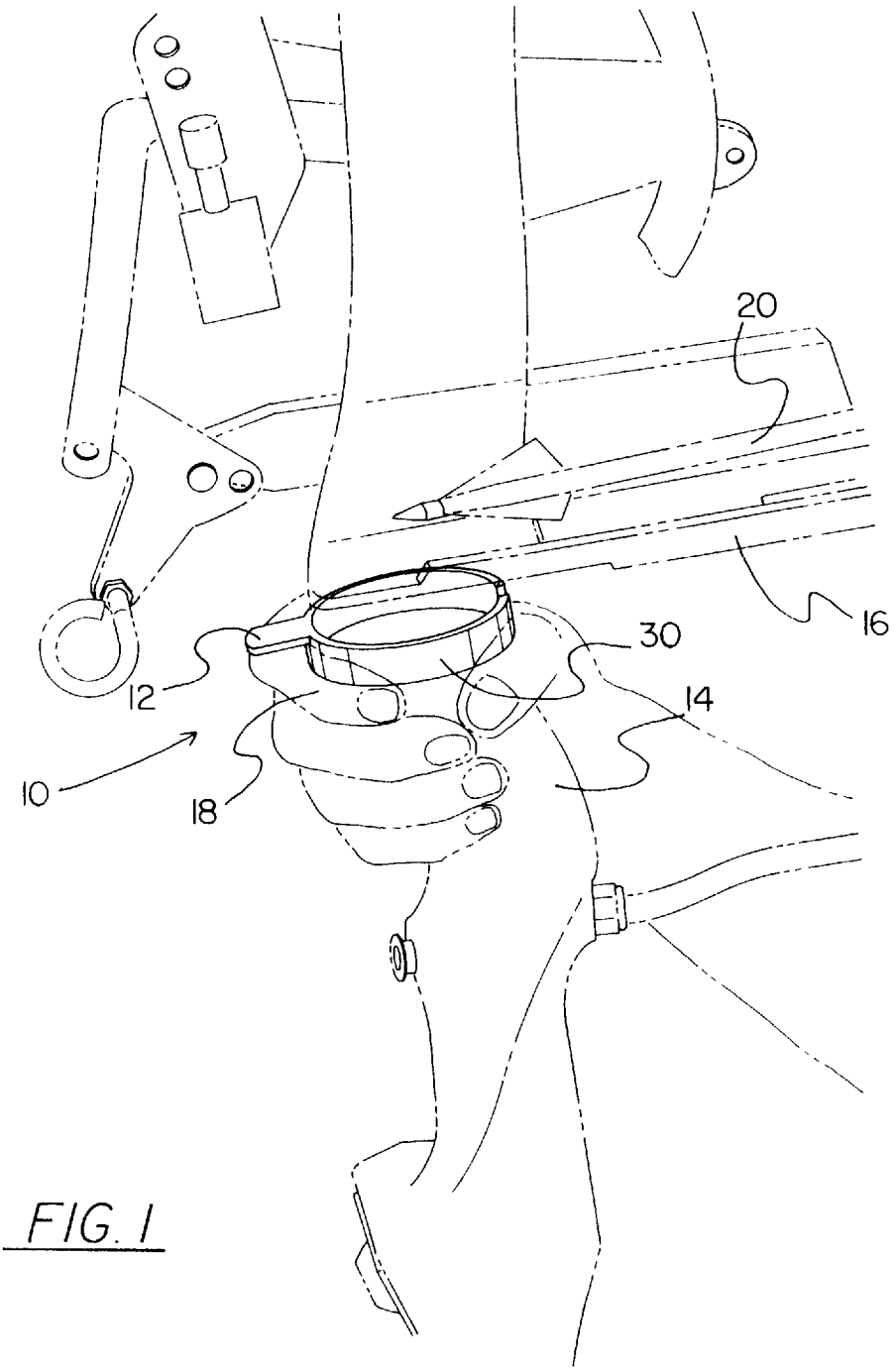
FIG. 1 is a perspective view of the preferred embodiment of the safety guard for bows constructed in accordance with the principles of the present invention.
Figure 2:
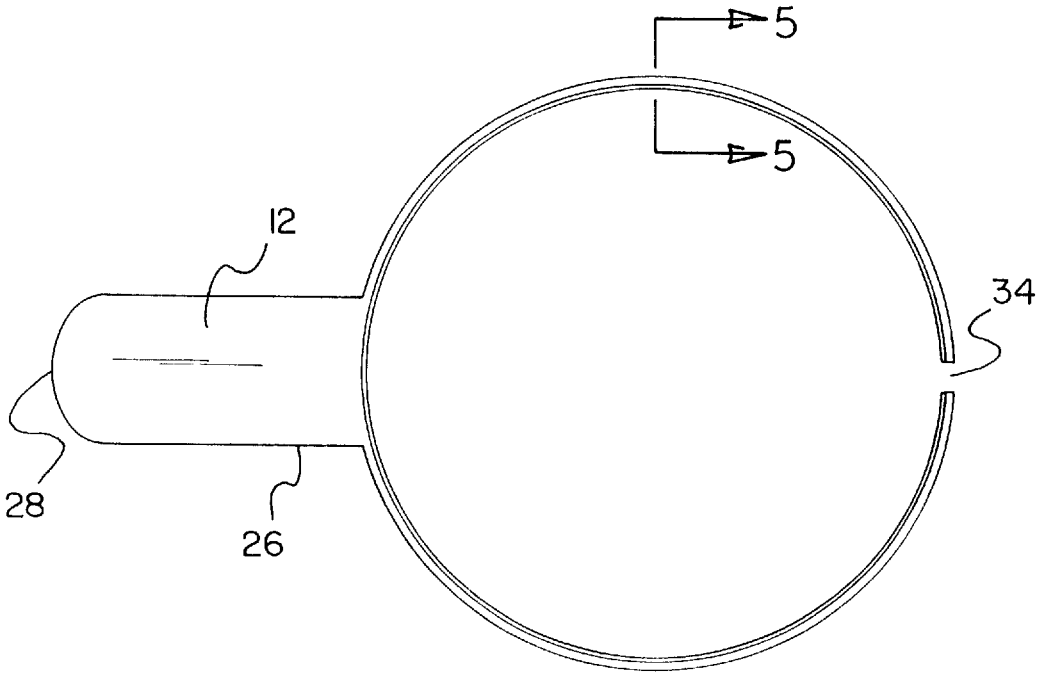
FIG. 2 is a top plan view of the present invention.
Figure 3:
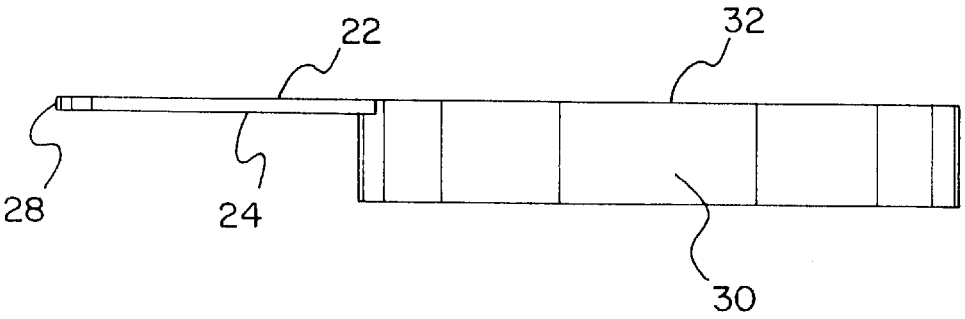
FIG. 3 is a side elevation view of the present invention.
Figure 4:
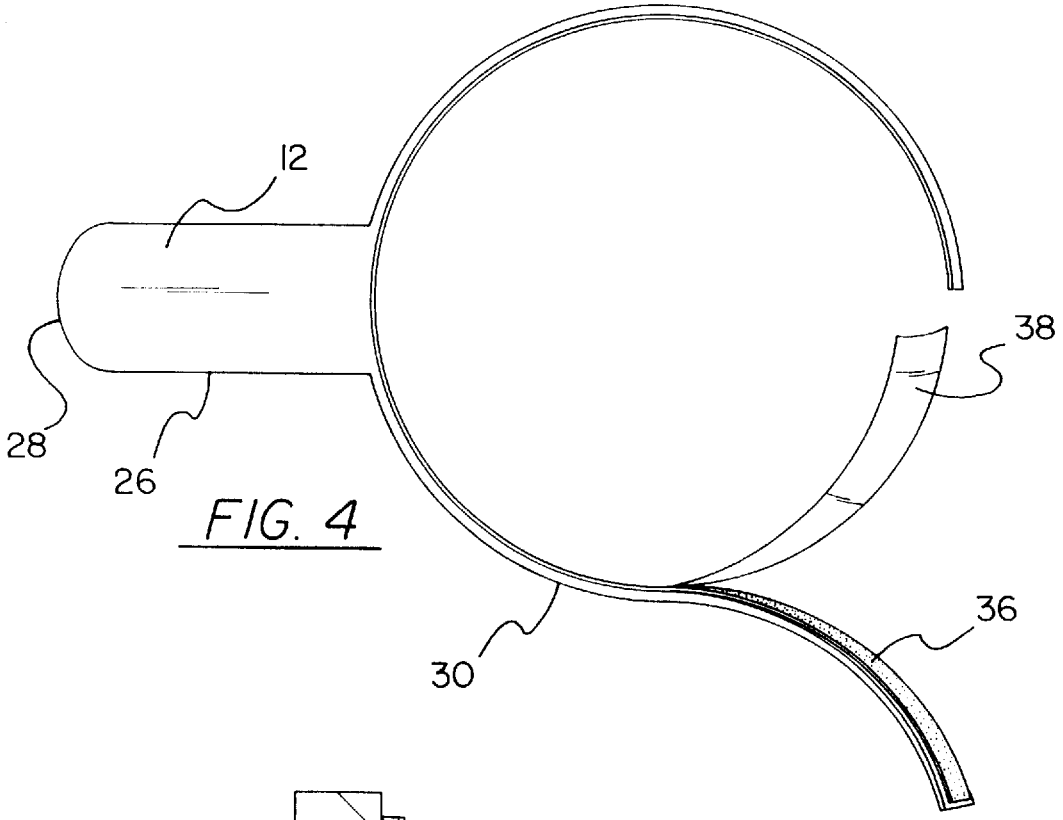
FIG. 4 is a top plan view of the present invention illustrating the peel-away adhesive.
Figure 5:
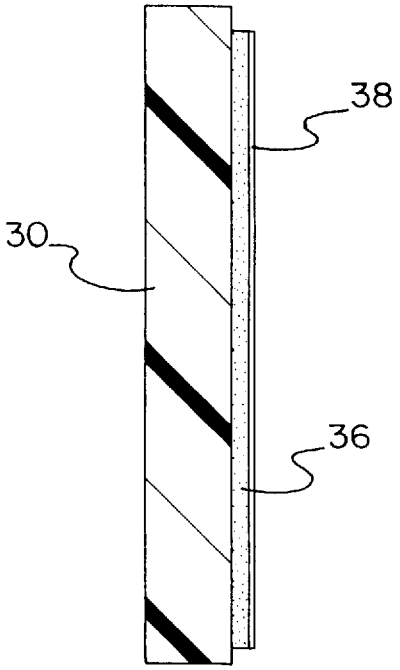
FIG. 5 is a cross-sectional view as taken along line 5—5 of FIG. 2.

With reference now to the drawings, and in particular, to FIGS. 1 through 5 thereof, the preferred embodiment of the new and improved safety guard for bows embodying the principles and concepts of the present invention and generally designated by the reference number 10 will be described.

Specifically, it will be noted in the various Figures that the device relates to a safety guard for bows for securing around a bow handle of a bow equipped with overdraws to prevent contact with an arrowhead. In its broadest context, the device consists of a tab and a circular band. Such components are individually configured and correlated with respect to each other so as to attain the desired objective.

The tab 12 is positionable on a bow handle 14 having an overdraw 16. The tab 12 extends forwardly from the bow handle 14. The tab 12, when positioned on the bow handle 14, will prevent a user's index finger 18 from raising upwardly into the firing line of an arrow 20. Note FIG. 1. The tab 12 has a length of about two inches. The tab 12 has planar upper 22 and lower surfaces 24, opposed linear side edges 26 and a rounded outer edge 28.

The circular band 30 is fabricated of a pliable material, such as a flexible plastic, and is securable around the bow handle 14 having an overdraw 16. The circular band 30 is integrally formed with the tab 12. Note FIGS. 2–4. The tab 12 extends radially outwardly from an upper peripheral edge 32 of the circular band 30. Note FIG. 3. The circular band 30 has a gap 34 therein diametrically opposed from the tab 12. An inner surface of the circular band 30 has adhesive 36 disposed thereon. A peel away strip 38 is disposed over the adhesive to protect the adhesive 36 prior to use.

The device 10 is designed to prevent cuts on fingers and hands. The device 10 is intended to keep the finger below the plane of the overdraw rest and also covers the finger to prevent contact with the arrowhead. The device 10 is preferably designed so as to universally couple with all bow handles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A safety guard for bows for securing around a bow handle of a bow equipped with an overdraw to prevent contact with an arrowhead comprising, in combination:

a tab positionable on a bow handle having an overdraw, the tab extending forwardly from the bow handle, the tab having a length of about two inches, the tab having planar upper and lower surfaces, opposed linear side edges and a rounded outer edge; and a circular band fabricated of a pliable material securable around a bow handle having an overdraw, the circular band being integrally formed with the tab, the tab extending radially outwardly from an upper peripheral edge of the circular band, the circular band having a gap therein diametrically opposed from the tab, an inner surface of the circular band having adhesive disposed thereon, a peel away strip disposed over the adhesive.

2. A safety guard for bows for securing around a bow handle of a bow equipped with an overdraw to prevent contact with an arrowhead comprising, in combination:

a tab positionable on a bow handle having an overdraw, the tab extending forwardly from the bow handle wherein the tab has a length of about two inches; and wherein the tab having planar upper and lower surfaces, opposed linear side edges and a rounded outer edge.

3. The safety guard as set forth in claim 2 and further including a circular band fabricated of a pliable material securable around a bow handle having an overdraw, the circular band being integrally formed with the tab.

4. The safety guard as set forth in claim 3 wherein the tab extending radially outwardly from an upper peripheral edge of the circular band.

5. The safety guard as set forth in claim 4 wherein the circular band having a gap therein diametrically opposed from the tab.

6. The safety guard as set forth in claim 3 wherein an inner surface of the circular band having adhesive disposed thereon, a peel away strip disposed over the adhesive.

* * * * *